United States Patent [19]

Bodine, Jr. et al.

[11] 4,107,579

[45] Aug. 15, 1978

[54] STARTING AND OPERATING BALLAST FOR HIGH PRESSURE SODIUM LAMP

[75] Inventors: Richard Hill Bodine, Jr., Germantown, Tenn.; Marion Rosiak, Athens, Ala.

[73] Assignees: Litton Systems, Inc., Bellwood, Ill.; Bodine Co., Inc., Collierville, Tenn. ; part interest to each

[21] Appl. No.: 809,994

[22] Filed: Jun. 27, 1977

[51] Int. Cl.[2] ..... H05B 37/00

[52] U.S. Cl. ..... 315/205; 315/206; 315/207; 315/DIG. 5; 315/DIG. 7; 315/276

[58] Field of Search ..... 315/205, 206, 207, 208, 315/276, DIG. 7, DIG. 5

[56] References Cited

U.S. PATENT DOCUMENTS

| | | | |
|---|---|---|---|
| 3,374,396 | 3/1968 | Bell et al. | 315/DIG. 5 |
| 3,407,334 | 10/1968 | Attewell | 315/DIG. 5 |
| 3,679,936 | 7/1972 | Moerkens | 315/205 |
| 3,699,385 | 10/1972 | Paget | 315/200 |
| 3,889,152 | 6/1975 | Bodine et al. | 315/205 |
| 3,924,155 | 12/1975 | Vogeli | 315/DIG. 5 |

*Primary Examiner*—Alfred E. Smith
*Assistant Examiner*—Charles F. Roberts
*Attorney, Agent, or Firm*—Ronald M. Goldman

[57] ABSTRACT

The HID lamp starting and operating apparatus of the invention includes inductive ballast means containing a winding and a core of magnetic material which may form a reactor or a transformer, and such winding is adapted for connection in circuit with an HID lamp; source means for supplying a cyclically varying AC voltage to said ballast means so as to provide AC voltage across said winding; first semiconductor switch means and a first capacitor means are coupled in circuit to said winding, responsive to said voltage across said lamp attaining a first predetermined instantaneous AC level, possible only during the time period before the lamp starts, for discharging the capacitor means through at least a portion of said winding at least once in each cycle of AC voltage to thereby generate high voltage pulses across said lamp and further responsive to said lamp being in the operating condition for terminating such capacitor discharging function; and second semiconductor switching means, including timing means associated therewith, said second switching means being responsive to application of said AC source to the ballast means for disabling said first switch means subsequent to the lapse of a predetermined interval subsequent to said application of said AC source, said second switch means being automatically resettable upon the disconnection of said AC source from the ballast means.

17 Claims, 5 Drawing Figures

STARTING AND OPERATING BALLAST FOR HIGH PRESSURE SODIUM LAMP

BACKGROUND OF THE INVENTION

The present invention relates to electrical starting and operating apparatus for high intensity gaseous discharge lamps and, in part, is considered to be an improvement of our prior apparatus for such lamps presented in U.S. Pat. No. 3,889,152, granted to the applicants June 10, 1975. As is known, high pressure gas vapor lamps, such as the metallic halide or sodium vapor lamps, require starting voltages that are higher than normal operating voltages when the lamp is drawing operating current; on the order of ten times the normal operating voltages in the case of high pressure sodium vapor lamps. To meet the starting and operating voltage requirements for those types of lamps on an economical basis, various electronic circuits have been used in combination with the reactor or transformer type lamp ballast to generate high voltage pulses for starting the lamp, as is represented in the prior art including our prior patent U.S. Pat. No. 3,889,152, to which the reader may make reference, as well as to U.S. Pat. No. 3,407,334 to Attewell; U.S. Pat. No. 3,679,936 to Moerkins; and U.S. Pat. No. 3,374,396 to Bell.

Generally speaking, the circuit in our prior patent relies on the general phenomenon of discharging a charged capacitor through a portion of the transformer or inductor winding, which serves as the ballast, to thereby by transformer-like action with the remaining winding portion generate a high voltage pulse that is applied across the HID lamp. The normal AC voltage across the lamp is monitored and at some phase during an AC half cycle the voltage in the circuit is sufficient to trigger the switching means and thereby quickly discharge the capacitor creating a high voltage pulse at that time. Subsequent to starting, the lamp operates and draws current and the impedances of circuit elements in series with the HID lamp limits the voltage thereacross to the lower operating voltage. This operating voltage is insufficient in level to thereafter trigger the aforementioned pulse generator switching device and generation of further high voltage pulses ceases. For a detailed understanding of the operation of our prior invention and the unique aspects thereof the interested reader should make reference to the description contained in the cited patent.

In practice, our prior invention has proved useful for its intended purpose but has revealed certain phenomena now considered undesirable. Specifically, in some instances the circuits were used with lamps that were inoperative or defective. However, under the principles of operation of our starting apparatus the high voltage generator continued to function. This caused continuing and persistent generation of the high voltage pulses that placed extra electrical stresses on the ballast reactor or transformer winding as well as presented possible radio frequency interference which it is desired to avoid.

The present invention improves upon such types of prior art starting and operating apparatus for HID lamps, including our own, by inhibiting pulse generation when the lamp is defective or inoperative. In general, it appears that this type of problem may have existed previously or at least appears to be generally presented in U.S. Pat. No. 3,699,385, issued Oct. 17, 1972, to Paget, which has been made known to applicants in connection with a related type of circuit. In Paget there is disclosed a time delay switch which inhibits the operation of a certain type of pulse generating portion of a lamp ballast circuit adapted for use with metal halide lamps, a type of lamp in which the sustaining lamp voltage is very important and the peak voltage requirement is below 1,000 volts. A predetermined time after the appearance of the AC line voltage applied to the ballast, the circuit cuts out or inhibits operation irrespective of whether or not the lamp is in fact in the operating condition, although in other respects the pulse generating circuit appears to continue to operate to some degree, even with the lamp in the operated condition, as described in such patent. A similar type of cut-out or inhibiting action circuit appears to be suggested also in U.S. Pat. No. 3,924,155, issued Dec. 2, 1975, designed for fluorescent lamps, which has been made known to us. The present invention generally follows along the same type of circuit operation described and employs a means to terminate operation of the pulse generator, which combination we believe to be invention in its specific respects in providing a reliable and efficient apparatus.

Accordingly, a principal object of our invention is to provide an improved starting and operating apparatus for HID type lamps and to provide an apparatus that avoids placing undue voltage stresses on associated reactors or transformers when the lamp is defective or removed.

SUMMARY OF THE INVENTION

Briefly, apparatus for starting and operating a high intensity gaseous discharge lamp of the type which requires a starting voltage in excess of ten times greater than its operating voltage from a power source of sinusoidal AC voltage, contains an inductive ballast means having at least a first winding comprising a predetermined number of turns of electrically insulated wire, located on a core of magnetic material, in which the winding is connected in series circuit with the lamp for supplying AC operating voltage thereto; first semiconductor switch means and capacitor means are coupled in a series circuit with a small portion of said winding; means coupled to the lamp which responsive to the instantaneous AC voltage thereacross attaining a predetermined level, which is possible only during the period before the lamp starts, for enabling said semiconductor switch means to switch into a current conducting state and enable discharge current to flow from said capacitor through said small winding portion which by transformer action thereby generates a high voltage pulse that appears across said winding and said lamp to provide requisite level starting voltage for said lamp; an AC to DC rectifier means provides DC voltage at an output responsive to the application of AC from said power source to said ballast means; time delay switch means including a resistor and capacitor formed into a timing network and a semiconductor switching means, with said switching means providing a first output responsive to the voltage across said timing network capacitor being below a predetermined level and providing a second output responsive to said voltage across said timing capacitor having a voltage thereacross above said predetermined level; means coupling said time delay switch means to the output of said AC to DC rectifier means for enabling said timing network capacitor to charge up over a relatively long interval of time to said predetermined voltage level and supply operating power to said switching means; bleeder resistance means coupled to said capacitor for dissipating said voltage thereacross to less than said predetermined level in the absence of DC at the output of said AC to DC rectifier means; and means operatively connected between the output of said semiconductor switching means and said first semiconductor switch means for inhibiting the latter responsive to said switching means being in said second output state, whereby high voltage starting pulses are generated until the lamp starts or a time interval elapses, whichever occurs first.

The foregoing objects and advantages of our invention and the structure characteristic of our invention, together with obvious modifications and equivalents thereto, become more apparent to the reader through consideration of the detailed description of the preferred embodiments of our invention, which follows, considered in connection with figures of the drawings illustrating same.

DESCRIPTION OF THE PREFERRED EMBODIMENTS

Figure 1:
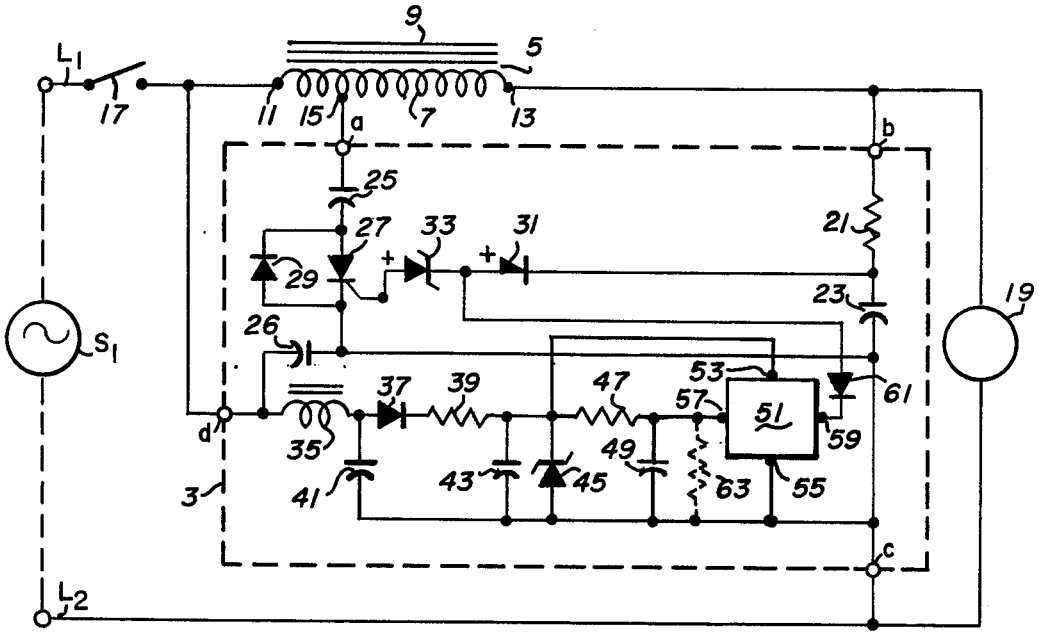
FIG. 1 illustrates a first embodiment of the invention in electrical schematic form.

The embodiment of FIG. 1 includes a conventional reactor type ballast 5 that contains a winding 7, formed of a suitable number of turns of electrically insulated wire, located on a core 9 of magnetic material. The core, typically, is formed of a stack of magnetic laminations. Winding 7 contains a first winding end 11, a second winding end 13 and a tap 15. The tap 15 is located a predetermined number of turns, N, from winding end 11 with the relationship between the turns N and the remaining turns, $N_t$, in winding 7 being such that the ratio $N_t/N$ is larger than one and preferably on the order of ten or more. The electrical power inputs to the circuit, designated as $L_1$ and $L_2$, are adapted for connection to an alternating current source, designated $S_1$ in the figure, typically the 120 or 240-volt 60-Hertz AC provided directly or indirectly by the utility company. For reference purposes, line $L_2$ is designated as the "circuit common" in the description of this embodiment. A switch 17, illustrated in the open position, is connected in electrical series circuit with winding 7 and source $S_1$. A gaseous discharge type lamp 19, suitably a sodium vapor high-intensity discharge type, is connected in circuit between winding end 13 and the circuit common. Various electronic elements and circuitry, hereinafter described, are included in a rectangle 3 formed by dash lines containing electrical terminals designated by lower case letters *a, b, c* and *d,* to indicate that those elements may be placed on a single printed circuit board in actual practice as well as to condense the description of alternative embodiments of the invention. A resistor 21 is connected in series circuit with a capacitor 23 between winding end 13 and circuit common $L_2$ to place same across and in parallel circuit with lamp 19. A capacitor 25 is connected in circuit between the winding tap 15 and the anode terminal of a silicon controlled rectifier 27 and the cathode of SCR 27 is connected to the circuit common via terminal *c.* A diode 29 is connected in parallel circuit with the SCR and oppositely electrically poled thereto so that the anode of the diode is connected in common with the cathode circuit of the SCR. A capacitor 26 is connected in circuit between the cathode of SCR 27 and winding end 11 via terminal *d,* which effectively places this capacitor in circuit across the line. A diac 31 and a Zener diode 33 are connected electrically in series circuit between the gate electrode of the SCR, the gate electrode being connected to the anode of Zener diode 33 and the circuit juncture between resistor 21 and capacitor 23, with the cathode of the diac 31 connected to said juncture. As illustrated, both Zener diode 33 and diac 31 are electrically poled in the same direction in the circuit. It is noted that the circuit described to this point is essentially the same as that presented in our earlier patent U.S. Pat. No. 3,889,152, granted June 10, 1975, with the addition of Zener diode 33 for reasons which hereinafter become apparent. An inductor or choke 35, as variously termed, of conventional structure, typically a winding of wire on an iron or ferrite core, a rectifier diode 37 and a resistor 39 are connected electrically in series circuit with one end of the inductor connected via terminal *d* in circuit with end 11 of ballast winding 7. A capacitor 41 is connected in circuit between the juncture of choke 35 and diode 37 and the circuit common $L_2$ and an end of resistor 39 is connected to one end of a filter capacitor 43 which, in turn, has its other end connected to the circuit common. A Zener diode 45 is connected in parallel with capacitor 43 with its anode terminal connected to the circuit common. As those skilled in the art recognize, the foregoing circuit defines a choke input type half-wave AC to DC rectifier circuit with capacitor 43 serving as the filter capacitor and Zener diode 45 acting as a protective or voltage limiting device to maintain the output DC voltage from exceeding a predetermined desired maximum level. A resistor 47 is connected in electrical series circuit with a capacitor 49 between one end of resistor 39 and the circuit common, which forms a conventional RC type timing network. An integrated circuit type electronic switching device 51, more particularly a voltage comparator, represented symbolically by the rectangle, includes a power supply voltage input 53 connected to the one side of resistor 39, a common terminal 55 connected to the circuit common, an input 57 connected in circuit to the juncture in the timing network of resistor 47 and capacitor 49, and an output terminal 59 connected in series with a diode 61 poled electrically with the cathode in common with output 59 and the anode connected to the juncture of Zener diode 33 and diac 31. The input resistance of circuit 51 is very high and is denoted in invisible lines in the figure as resistor 63 for reasons which hereafter become apparent. Integrated circuit 51 is a conventional device which contains the structure of a voltage comparator and a Schmidt trigger known to those skilled in the art, such as may be obtained from the Signetics Company of Sunnyvale, California, as Model No. NE555. The device exhibits the characteristic of providing a voltage at its output, 59, of about the same level as at terminal 55, the circuit common, when the voltage applied at its input 53 is equal to or greater than 0.66 of the supply voltage at terminal 53 or V53; and switches the voltage at output 59 to the supply voltage level V53 when the voltage applied at input 57 reduces below 0.66 V53. In operation of the improved starter circuit, when it is desired to energize lamp 19, switch 17 is closed to complete a current conducting path from power source $S_1$ to the ballast winding 7. The AC voltage so applied in the described series circuit appears at winding end 13 and across lamp 19 and is typically insufficient in level to start lamp 19. For example, an HID lamp Model No. S-55 typically requires a starting voltage on the order of 2,700 volts to initially ionize the gases and has an operating voltage substantially lower on the order of 55 volts; and an LU-250 requires 2,500 volts starting and 100 volts operating voltages. When the polarity of the AC voltage at $L_2$ is positive with respect to that on $L_1$, current flows through rectifier diode 29 into capacitor 25 and through the small portion of winding 7 between tap 15 and back through switch 17 to the other terminal of the source to electrically charge capacitor 25 to the line voltage. On the opposite AC half cycle, when the voltage on line $L_1$ is positive with respect to that on $L_2$, current flows through winding 7, resistor 21, and capacitor 23, back through the circuit common to the other end of the source. By selecting appropriate values for resistor 21 and capacitor 23 that sinusoidal voltage at some point in time builds up to a level across capacitor 23 which exceeds the breakdown voltage of diac 31 only when lamp 19 has not started. At such time during this AC half cycle, the diac switches from a normally nonconducting to a current conducting state. Similarly, Zener diode 33 is by design normally nonconducting. With a large enough reverse voltage, however, the Zener diode switches into its reverse current conducting condition. With both elements 31 and 33 in the current conducting state, a positive voltage is presented to the gate electrode of SCR 27 and a current conducting path is completed through the gate electrode and the cathode terminal around through to capacitor 23, causing the SCR 27 to switch into its current conducting state. Inasmuch as the charge on capacitor 25 was made positive, +V, during the preceding half cycle and to that is now added the +V voltage appearing at tap 15 during the existing half cycle, the voltage level at anode of SCR 27 is approaching twice that of the line. The SCR switches into its current conducting condition and conducts a discharge current from capacitor 25 through the end turns of the winding 7 between end 11 and tap 15 and through capacitor 26. This large sudden current, through an autotransformer type action, generates a high voltage in the remaining portion of winding 7 because of the substantially larger number of turns in that winding portion. As a result, a large positive or negative going voltage spike, a voltage on the order of 3,000 volts, appears at winding end 13 and is hence applied across lamp 19. The aforedescribed pulse generating action is seen to generate a high voltage pulse during the one-half cycle in each AC cycle during which the line voltage $L_1$ is positive with respect to the common circuit line $L_2$ and the foregoing action continues so long as lamp 19 does not start.

Should the lamp start, current flows in the series circuit of lamp, ballast and source, and the voltage across the series circuit of resistor 21 and 23 reduces to that of the operating voltage level of or voltage "drop" across the lamp. By design, with the lamp operating capacitor 23 cannot charge up to a voltage sufficient to cause diac 31 to switch into the current conducting state. Hence, the pulse generating action previously described automatically terminates. The aforedescribed circuit action is more fully described in connection with various embodiments in the previously identified patent U.S. Pat. No. 3,889,152 to which reference is made.

In addition, the initial closure of switch 17 provides AC voltage at inductive choke 35. Current through the choke is rectified by rectifier 37 and passes through resistor 39 into capacitor 43 to electrically charge the capacitor up to the power supply voltage limited by the Zener diode 45. Capacitor 41 serves to suppress surge voltages. Initially, the application of this DC voltage appearing across Zener 45 is coupled to integrated circuit 51. The integrated circuit normally produces a positive voltage at its output 59 thus blocking or preventing diode 61 from conducting current and leaving the midpoint or circuit juncture between Zener 33 and diac 31 in an essentially neutral condition. The timing circuit consisting of resistor 47 and capacitor 49 has a time constant, T, which is substantially larger than the time of one AC cycle, 16 milliseconds at a frequency of 60 hertz, and, for example, is on the order of 10 seconds or more. Thus, assuming a time constant of 10 seconds, by way of example, application of a DC voltage to the input end of resistor 47 will require a time of 10 seconds before the voltage across capacitor 49 builds up to the level of approximately 67 percent of that input voltage. As soon as the voltage to the input 57 of the integrated circuit 51 builds up to the level equal to switching level, the circuit 51 switches its output from a positive to a negative voltage level placing the diode 61 in the current conducting condition. As a result, the juncture between diac 31 and Zener 33 is placed at a negative voltage level. Thus, if in the aforedescribed circuit, lamp 19 is in its nonilluminated condition and did not start and draw current within the prescribed time interval, such as the 10 second example, each time the voltage across capacitor 23 builds up to a level sufficient to cause diac 31 to break down the current from the capacitor is shunted from Zener 33 and the gate electrode of SCR 27. The current instead is passed through diac 31 into the integrated circuit and internally therethrough back to the circuit common. Thus at the conclusion of the prescribed time interval the operation of SCR 27 is inhibited and high voltage pulses can no longer be generated.

As is apparent, the circuit automatically resets and the described operation may be repeated by opening switch 17 to remove all voltage from the circuit. In so doing, the charge across capacitor 49 is dissipated or bled off by a discharge current passing through inherent resistances in the circuit, such as the input circuit of IC 51 to the circuit common. And reclosure of the switch 17 permits reoperation of the pulse generating circuit in the same manner described for the prescribed time interval at a maximum. Thus the described starting and operating circuit for lamp 19 embodies a pulse generator type action which generates high voltage pulses until the pulse generating action is inhibited through either one of two events: (1) the operation of the lamp 19, and (2) the end of the time interval set essentially by the timing circuit consisting of the resistor 47 and capacitor 49. As a result, if the lamp is permanently inoperative, as evidenced by failure to operate within the prescribed maximum time interval chosen by the circuit designer, there is no need to generate high voltage pulses over long intervals that might endanger or destroy the winding 7 of the ballast reactor or present a personnel hazard if the lamp is removed or is inoperative just as there is no need to continue generation of high voltage pulses once a good lamp has operated.

As the reader may note, the integrated circuit semiconductor switching means 51 remains in the second output state as long as power from source $S_1$ is supplied to the circuit. Should one wish to try again to operate the lamp after the 10 second interval it is necessary to open switch 17 and after a moment reclose the switch to reapply the AC source to the circuit. In operating switch 17 to the open position, power is removed from the AC to DC rectifier circuit and hence from electronic switch 51. The voltage on capacitor 23 in the timing circuit, that might otherwise persist for a long period, is bled off by discharging the capacitor through bleeder resistance 63, furnished by the circuit 51 although other discreet resistors may be added for that same purpose. The circuit thus automatically resets to the normal condition when source $S_1$ is removed from the circuit.

Figure 2:
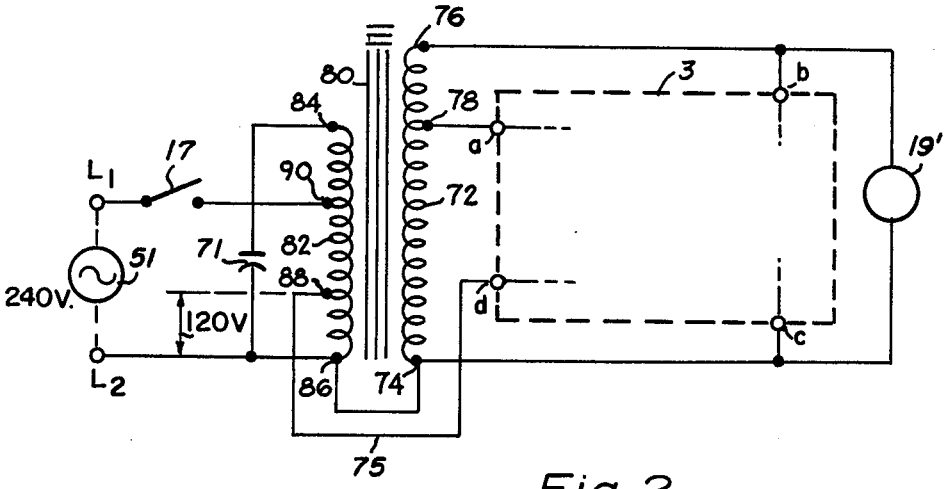
FIG. 2 illustrates an alternative form of the embodiment of FIG. 1 presented in electrical schematic.

By way of example, a specific embodiment of our invention employed the following:

Source: 120 volts, 60 Hertz
Winding 7: 308 turns
Tap 15: 28 turns from end 11
Resistors 21: 120 K ohms
Resistors 39: 47 ohms
Resistors 47: 470 K ohms
Capacitors 25: 0.1 microfarads
Capacitors 23: 0.1 microfarads
Capacitors 41: 0.01 microfarads
Capacitors 43: 22 microfarads
Capacitors 49: 22 microfarads
Diodes 61: 1N4003
Diodes 37: 1N4003
Diodes 29: 1N4005
Zeners 33: 10 V.
Zeners 45: 10 V.
SCR 27: 3A - 400 V.
Diac 31: ST-2
Inductor 35: 25 turns
Lamp 19: S-55 HPS The embodiment of FIG. 2, which is next described, illustrates an alternative arrangement for starting and operating lamp 19'. For convenience, where the element illustrated and described in connection with the discussion of the embodiment of FIG. 1 is identical, it is similarly labeled. Additionally, inasmuch as the portion of the circuit illustrated in the embodiment of FIG. 1 in the rectangle 3, formed of dash lines, is the same as that illustrated in dash lines in this figure with the circuit terminals *a, b, c* and *d*, the contents thereof need not be again illustrated or in detail described inasmuch as the elements operate and function together in the same way as described in connection with the embodiment of FIG. 1.

In this embodiment the lamp ballast means includes the transformer winding 72 with first winding end 74, second winding end 76, and an intermediate tap 78. The winding consists of a predetermined number of turns of electrically insulated wire and the tap defines a predetermined winding portion between the location of tap 78 and winding end 76 which is substantially smaller than the remaining winding portion between tap 78 and winding end 74 to establish a large turns ratio greater than one between the remaining winding portion and the defined winding portion. Winding 72 is located on a core of magnetic material 80 represented by the three spaced lines. A second or primary winding 82 consisting of a predetermined number of turns of electrical insulated wire, substantially fewer turns that than in winding 72, is located similarly on core 80 in spaced relationship with winding 72 so as to define a loose coupling between the two windings, sometimes characterized as a high leakage reactance relationship, symbolically denoted by the three short lines in the figure. Winding 82 includes a first winding end 84, second winding end 86 and two intermediate taps 88 and 90. A capacitor 71 is connected across winding 82. The source S1 of AC power is adapted for connection to winding 82 between winding end 86 and tap 90 upon closure of the switch 17, illustrated in the open circuit position. Tap 88 is connected via terminal *d* to the input of the AC to DC rectifier, as illustrated, by wire 75, and winding ends 86 and 74 of winding 82 and 72, respectively, are connected together so as to place the windings in the conventional autotransformer relationship and to place L2 as the circuit common in circuit with lamp 19' and terminal *c*. Tap 78 is connected in circuit with element 3 via terminal *a*, and winding end 76 is connected thereto via terminal *b*. Capacitor 71 together with winding portion between tap 90 and end 84 serves to provide a power factor correction for the circuit, presumably by adding a slightly leading reactance to compensate for the lagging reactance of the remaining circuit element as viewed electrically by the source S1. In the other respects, the lamp 19' is shown series coupled with winding 72 and the winding 72 provides the AC voltage on the normal operating levels of lamp 19', whereas the circuitry illustrated in the dashed lines is connected to the defined winding portion to generate the high voltage pulses which appear across the lamp to encourage the lamp to start in the same manner as described in connection with the embodiment of FIG. 1. Similarly the lamp once started draws current through winding 72 and the voltage drop across lamp 19' and hence across the resistor and capacitor circuit, not illustrated, in element 3 via terminals *b* and *c* connected across the lamp, is reduced, resulting in a discontinuance of the high voltage generating action as previously described in connection with FIG. 1. Lastly, the existence of AC on input lead 75 provides power for the timing circuit illustrated in the dashed lines to that at the conclusion of a predefined interval defined by the RC network embodied therein the output disables the pulse generating action if such action has not otherwise ceased through operation of the lamp and thus ensures termination of high voltage pulses if the lamp is defective or is otherwise removed from the circuit.

By way of specific example, the details of transformer is given as follows:

Winding 72: 216 turns
Tap 78: 192 turns from end 74
Winding 82: 205 turns
Tap 88: 205 turns from end 86
Tap 90: 64 turns from end 86
Capacitor 71: 15 microfarads.

The elements in circuit 3 may be identical to that given hereinbefore in connection with FIG. 1.

Figure 3:
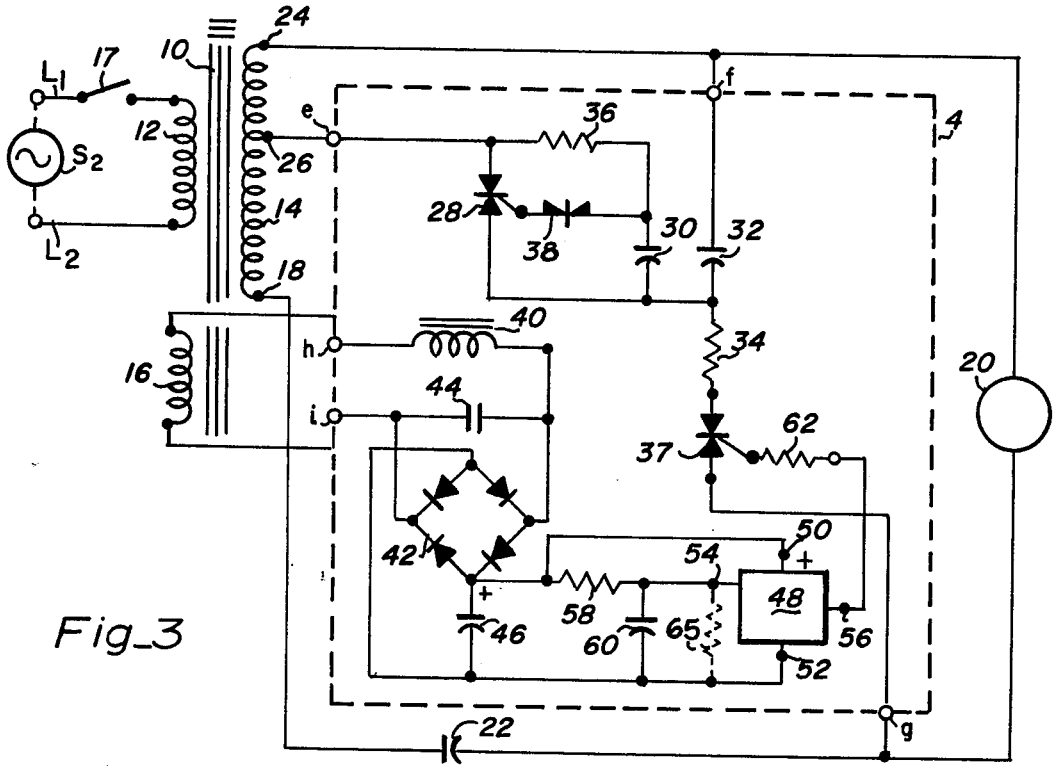
FIG. 3 presents another embodiment of the invention in electrical schematic form.

Reference is now made to another embodiment of the invention presented in FIG. 3. The apparatus includes a ballast transformer 10 containing a primary winding 12, a first secondary winding 14, and a second secondary winding 16 located on a core of magnetic material, typically a stack of magnetic iron laminations. The windings are formed of various members of turns of electrically insulated wire, as is conventional practice. This transformer is of the high leakage reactance type in which the secondary 14 is "loosely coupled" electromagnetically to primary 12, such as by being located spaced apart on a common leg of the core. This loose coupling is symbolically illustrated by the three dashed lines drawn perpendicular to the three lines representing the magnetic core. Winding 16, however, is located preferably over the primary 12 and is thus closely coupled to the primary. A sodium vapor high intensity discharge lamp 20 and a capacitor 22 are connected in electrical series circuit with secondary 14 across secondary winding ends 18 and 24. Secondary 14 contains an electrical tap 26 located a predetermined number of turns, N, from secondary winding end 24. As in the preceding embodiment, the total number of turns in the winding and the turns in the remaining winding portion $N_p$ is substantially greater than N, suitably by a factor of 10 or more.

Various electronic elements and circuitry, hereinafter described, are included in a rectangle 4 formed by dash lines containing electrical terminals designated by lower case letters *e, f, g, h,* and *i* to indicate that such elements may in actual practice be mounted on a single printed circuit board as well as to condense the description of alternative embodiments of the invention.

A thyristor 28 has one end connected in circuit with tap 26 via terminal *e* and its other end connected in circuit with the juncture of a capacitor 32 and a resistor 34. A resistor 36 and a capacitor 30 are connected in series circuit across the thyristor with the resistor terminal common with tap 26. As is illustrated, a diac 38 has one end connected to the gate terminal of thyristor 28 and its other end connected to the circuit juncture between resistor 36 and capacitor 30. Capacitor 32, resistor 34 and a second thyristor 37 are connected electrically in series circuit between winding end 24 via terminal *f* and an end of capacitor 22 via terminal *g* so as to place the circuit in electrical parallel circuit across lamp 20.

As is recognized by those skilled in the art, the apparatus to the extent described at this point, exclusive of the second thyristor 37 and winding 16, is an existing apparatus known prior to our invention. A filter choke 40 is connected via terminal *h* in series circuit with one end of winding 16 to one input of a conventional four diode type bridge rectifier 42. The remaining input of the bridge rectifier is connected via terminal *i* to the remaining end of winding 16. A capacitor 44 is connected across the input arms of the rectifier bridge which together with inductor 40 serves to minimize the effect of transient surge voltages and currents. A filter capacitor 46 is connected across the two outputs of bridge 42. As those skilled in the art appreciate, what is illustrated is a choke input AC to DC bridge rectifier circuit.

A semiconductor integrated circuit voltage comparator type switching device 48, symbolically represented in the figure, includes a power input 50, a common input 52, a drive input 54 and an output 56. A resistor 58 and capacitor 60 are connected in electrical series circuit across capacitor 46 and forms a conventional RC timing circuit having a time constant substantially greater than the period of the 50 or 60 hertz AC line frequency. The circuit juncture of the timing circuit is connected to the drive input 54 of the integrated circuit. The high input resistance presented by comparator 48 is represented in invisible lines as resistor 65, since that resistance serves as a bleeder resistor for capacitor 60 as hereinafter described.

Output 56 of the switching device 48 is connected in series with a resistor 62 to the gate terminal of thyristor 37.

In the operation of this apparatus, the primary 12 is connected to the AC power source, designated S1, as in the preceding embodiment, which supplies AC line voltage typically at 50 to 60 hertz frequency and either 120 or 240 volts, by closure of the normally open switch 17 and current flows into the primary. Through transformer action the current supplied to the primary and voltage appearing across the primary is transformed and appears as an AC voltage across secondary 14 and another AC voltage across secondary 16. The level of the respective secondary voltages depends initially upon the turns ratio between the secondary and the primary winding. By design, winding 14 contains sufficient turns to provide operating voltage to lamp 20 and the turns ratio between windings 14 and 12 is greater than one but less than 10. On the other hand, winding 16 supplies low voltages required by the semiconductor circuit, hence typically the turns ratio between windings 16 and 12 is less than one but greater than 1/100.

Voltage comparator 48 effectively is a switching device having first and second output states determined by the voltage at its input being above or below a predetermined voltage level. The output at 56 is a voltage equal to the positive DC supply, when the input voltage is less than the predetermined level, which is the case when the power supply is first turned on. The output at 56 switches to low or negative supply level when the input voltage exceeds the predetermined level, such as occurs across capacitor 60 at a time equal to $(1.1)\times(R_{58})\times(C_{60})$ after application of the DC voltage to the RC timing network. Initially, the gate of thyristor 37 is biased positive through the output provided at 56, a positive voltage. Hence, thyristor 37 is normally in the current conducting condition.

As is understood, the HID lamp 20 requires a high voltage for starting, typically many times greater than the voltage provided across winding 14, although once placed in the current conducting condition the lamp requires a substantially lower voltage for continued operation. Thus lamp 20 draws essentially no current at this time. However, a current flows from the secondary through capacitor 32 to resistor 34 and thyristor 37 and capacitor 22 in one AC half cycle to charge capacitor 32. Additionally, current through tap 26, resistor 36 and capacitor 30 into the circuit juncture resistor 34, thyristor 37 and capacitor 22, charges capacitor 30. As soon as the voltage during the AC half cycle attains a level at which the charge in capacitor 30 results in a voltage thereacross sufficient to break down or switch diac 38, diac 38 switches into the current conducting condition, completing a path for discharge of capacitor 30 through the gate electrode of the thyristor and the one main electrode to which the capacitor is connected and in so doing switches thyristor 28 into the current conducting condition. The thyristor in so switching effectively acts as a switch or short circuit between one end of capacitor 32 and tap 26 resulting in a large discharge current through capacitor 32, thyristor 28, the winding portion of secondary 14 between tap 26 and end 24. Through transformer action, the current through that portion of the secondary creates a magnetic flux in the transformer core which generates a voltage across the remaining portion of the secondary determined in level essentially by the turns ratio existing between the two portions of the secondary which, as earlier stated, was at least a factor of 10. In turn, this large voltage is impressed across the series combination of capacitor 22 and lamp 20 during the AC half cycle so as to encourage ionization and starting of lamp 20. On the opposite AC half cycle a similar high voltage spike is produced so that in this instance the high voltage pulse generating circuit produces one pulse during each AC half cycle or 120 pulses per second with a 60 hertz AC power source. In the operation of this pulse circuit, as soon as lamp 20 starts and draws a large current through winding 14 and capacitor 20, the voltage across the lamp is reduced in level and the circuit operates as a normal constant current type operation familiar to those in the lamp art, in a series circuit of secondary 14, capacitor 22 and lamp 20. Accordingly, the voltage drop across resistor 34 is reduced and cannot thereafter attain the peak level necessary to there break down or fire diac 38. Consequently, additional high voltage pulses are not produced.

When power switch 17 was closed to supply current to primary 12, low voltage AC appears across secondary 16. That AC voltage is filtered by choke 40 and capacitor 44 to prevent application of transient voltage as may from time to time appear and the low voltage AC is applied to the input arms of bridge rectifier 42 which rectifies the AC voltage to DC. The rectified DC output is filtered by and appears across capacitor 46 and is applied to "+" power input terminal 50 of element 48 which responds with the positive output voltage at output 56. The DC output voltage is also applied to the timing network and a charging current flows through resistor 58 into capacitor 60. After the lapse of a predetermined interval determined by the time constant of the timing circuit, the voltage across capacitor 60 attains a predetermined level. At that level the voltage at input 54 of voltage comparator switching device 48 is sufficient to effect a change in its output state from a voltage high to a voltage low condition. By design, this time is on the order of 10 seconds or more.

The voltage low is applied via resistor 62 to the gate of thyristor 37. Inasmuch as the gate terminal of the thyristor is no longer properly biased, thyristor 37 switches to the off condition as soon as the AC current therethrough has reached an instantaneous zero level and in effect opens the circuit between resistor 34 and capacitor 22. Assuming that the lamp 20 had not yet operated in the preceding description, as in the instance where the lamp is defective, the open circuit in the series circuit prevents capacitor 32 from receiving a charge. Consequently, current is no longer discharged through the winding portion between tap 26 and end 24 and high voltage pulses, accordingly, are no longer generated.

As in the embodiment of FIG. 1, the comparator 48 remains in the second output state thereafter until one wishes to try again, opens switch 17 to remove power from the ballast, and then after a moment recloses switch 17 to reapply AC power to the ballast transformer. During the interval in which power is removed from the circuit, AC voltage is removed from inputs *h* and *i*, bridge rectifier 42 does not supply DC voltage and the voltage across capacitor 60 is dissipated by a discharge current which passes through resistance 65, and falls below the predetermined level necessary to switch device 48 into the second output state. Thus, comparator device 48 restores and when power is reapplied the comparator is in its first output state supplying a positive voltage high at output 56. In effect, the circuit automatically resets to the normal condition when source S1 is removed from circuit with the apparatus.

By way of specific example, a practical embodiment of FIG. 3 used the following:

Winding 12: 198 turns
Winding 14: 510 turns
Tap at 26: 476 turns from end 18
Winding 16: 18 turns
Capacitor 32: 0.22 microfarads
Capacitor 22: 24 microfarads
Capacitor 30: 0.1 microfarads
Capacitor 60: 22 microfarads
Capacitor 46: 22 microfarads
Capacitor 44: 0.01 microfarads
Resistor 36: 270K ohms
Resistor 34: 8K ohms
Resistor 58: 470K ohms
Choke 40: 25 turns
Voltage comparator 48: NE555
Lamp 20: S-50 HPS
Thyristor 28: T2800D type mfd. by RCA
Thyristor 37: T2800D type mfd. by RCA
Rectifier bridge 42: 1A-100V The starting and operating circuit of this embodiment thus includes all of the features of the preceding embodiment and requires the lamp to operate within a predetermined interval of time before the high voltage pulse generator is turned off automatically and if operated within that time also automatically turns off the pulse generator.

Figure 4:
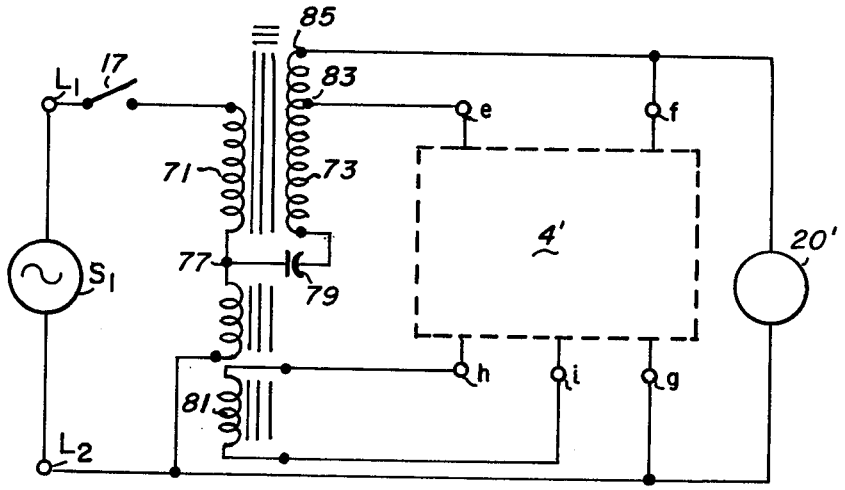
FIGS. 4 and 5 present two alternative embodiments of the embodiment of FIG. 3.

The embodiment of FIG. 4 presents the starting and operating apparatus of the invention in a constant wattage autotransformer arrangement. This includes a transformer primary winding 71, a secondary winding 73, located on a core of magnetic material 75, with the primary and secondary winding 73 loosely coupled to one another, symbolized by the three short dashed lines as understood by those skilled in the art. The primary contains a tap 77 located at a predetermined number of turns from one end of the primary and a capacitor 79 is in circuit between tap 77 and one end of secondary 73 which places the secondary and a portion of the primary in a series AC circuit whereby the AC voltages of the primary are additive to those of the secondary in a known autotransformer relationship. A third auxiliary transformer winding 81, consisting of a few number of turns of insulated wire, is wound over primary 71 or, alternatively, closely adjacent thereto so as to preferably minimize the leakage reactance between the two windings. In accordance with the teachings of the embodiment of FIG. 3 the secondary 73 in this figure includes a tap 83 a predetermined number of turns away from the winding end 85. To avoid unnecessary repetition, the electronic circuit presented within the rectangle 4 in dash lines in FIG. 3 is incorporated in this figure illustrated solely by the rectangle 4' formed in dash lines. The corresponding inputs to circuit 4' are similarly designated by the lower case letters *e, f, g, h* and *i*. As illustrated, input *e* is connected in circuit with tap 83; input *f* is connected in circuit with winding end 85 of secondary 73; input *g* is connected in circuit with one end of lamp 20' and the one end of the primary 71; input *h* and *i* are connected respectively to the alternate ends of the winding 81. The remaining end of lamp 20' is connected to winding end 85. The ends of primary 71 are connected to the lines L1 and L2 and to an AC power source S1 in series circuit with normally open switch 17 and are noted to be the same elements described in the preceding embodiments.

As is apparent to the reader, the lamp 20' is placed in a series electrical circuit with winding 73, a portion of winding 77, capacitor 79, by means of which the lamp receives normal operating voltages and current once it has started.

Source S1 represents the 120 volt, 60 cycle AC. On closure of switch 17, AC voltage is applied across primary 71 and current flows through the primary inducing a voltage in secondary 73 and in the auxiliary winding 81, producing AC voltages which are governed by the relative turns ratio between the primary and the respective secondary and auxiliary windings. Accordingly, the AC voltage applied at inputs *h* and *i* is coupled into circuit 4'. The AC voltage derived from the transformer action aforedescribed is applied across lamp 20' but is as earlier noted insufficient in level to ionize the gases in the lamp required for starting same. Through the circuit action of circuit 4' a current pulse flows in winding portions 85 and 83 upon discharge of the interval capacitor at the appropriate interval, in accordance with the operation thereof described in FIG. 3. Through transformer action the current through the small winding portion generates a high voltage pulse or spike across winding 73 which, in turn, is applied in series with lamp 20' and accordingly these high voltage pulses are applied across lamp 20' to start same. After the lapse of a predetermined time interval, by way of example, 10 seconds from the time the AC voltage was applied across terminals *h* and *i* of circuit 4', which essentially corresponds to the time from which switch 17 was closed in applying the AC source to the ballast transformer, output pulses through winding portions between 83 and 85 cease, irrespective of whether or not lamp 20' is ignited. Of course, should lamp 20' operate, the voltage across terminals *f* and *g* is reduced which, as was earlier described, effects termination of the pulse generating action.

Figure 5:
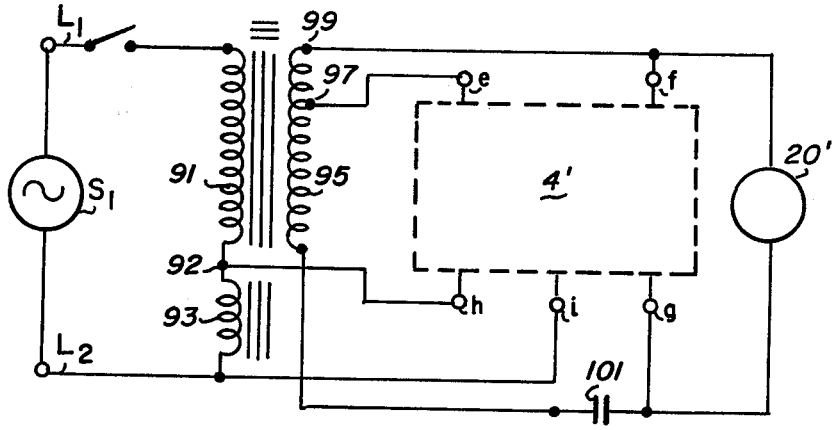

An alternative embodiment to that presented in the embodiment of FIG. 3 is additionally presented in FIG. 5 which has the structure of a constant wattage isolated primary lamp starting and operating device. For convenience, the source S1, lines L1 and L2, and normally open switch 17 are employed in the illustration of this embodiment. A primary winding 91 comprising a certain number of turns of electrically insulated wire contains a tap 92 at a predetermined number of turns from one end thereof and that winding is located on a core of magnetic material 93. Additionally, a second winding 95, comprising a predetermined number of turns of electrically insulated wire, is also located on magnetic core 93 in spaced relationship with that of the primary so as to provide a loose coupling or high leakage reactance coupling between the primary and the secondary, as variously termed and understood by those skilled in the art. In accordance with the principles previously discussed, secondary 95 includes a tap 97 a few turns from the one end 99.

One terminal of lamp 20' is connected in series with a capacitance 101 and the remaining end of secondary 95. In this figure, for convenience, the circuit elements presented in the rectangle 4 in FIG. 3 are employed in this figure, represented solely by the rectangle 4', with corresponding input terminals designated by the lower case letters *e, f, g, h* and *i*. The remaining terminal of lamp 20' is connected to secondary winding end 99 so as to place the secondary 95, capacitor 101, and lamp 20 in electrical series circuit, a configuration well known as a constant wattage circuit. Terminal *f* and terminal *g* are connected to respective alternate terminals of lamp 20' so as to be responsive to the voltage level applied across the lamp. Input terminal *e* is connected in circuit with tap 97 and terminals *h* and *i* are connected respectively to one end of the primary winding and to the tap 92. The normally open switch and the source S1 are connected in series circuit with primary 91. Closing switch 17 applies AC voltage from source S1 across winding 91 and current is supplied thereto from the source. Inasmuch as the turns of the primary act as a voltage divider, the voltage at tap 92 is of a reduced level depending on the turns ratio between the two portions of the windings. Thus, a lower AC voltage is applied across terminals *h* and *i* of circuit 4' to permit commencement of the timing interval described in connection with the preceding embodiments. Through transformer action governed by the turns ratio between winding 95 and primary 91 a higher AC voltage is applied across the series connected capacitor 101 in lamp 20 but, as previously discussed, is insufficient in level to provide the high starting voltages, but allowing a high voltage to appear across lamp 20'. Through the internal pulse generator action inherent in circuit 4', as described in detail in connection with FIG. 3, current pulses are driven through tap 97 and through the winding portion 99. This current surge through transformer action, more particularly autotransformer type action, generates a high voltage across the entire winding 95 that is significantly higher in level and greater than the starting voltage required for lamp 20. In the event that lamp 20' operates and draws current through the winding 95 in series connected capacitor 101, the voltage thereacross reduces to the operating level, hence the circuit 4' monitoring this voltage at terminals *f* and *g* inhibits further generation of current pulses into tap 97 out of terminal *e*. Alternatively, at the conclusion of the interval of time subsequent to the application of the AC across terminals *h* and *i* of the circuit, should lamp 20' not otherwise be operated, the electronics in 4' function as previously described in connection with the description of FIG. 3 to terminate the generation of the same current pulses via terminal *e* into tap 97.

It is again noted that the pulse generator remains inhibited until the power is removed from primary 91, such as by operating switch 17 to the open position. After the lapse of a momentary interval, the electronics within circuit 4' result in automatically resetting the circuits so as to permit the aforedescribed circuit action to be repeated upon reclosure of switch 17.

As is apparent to those skilled in the art, many additional variations of the invention are possible. It is believed that the preceding description of the preceding embodiments is sufficiently detailed so as to enable one of ordinary skill in the art to make and use same. However, it is expressly understood that the description presented for the foregoing purpose is not intended to limit the invention and that the invention is to be broadly construed to include all modifications and equivalents which fall within the full breadth and scope of the claims appended hereto.

What we claim is:

1. In a starting and operating apparatus for starting and operating a high intensity gaseous discharge lamp from a source of sinusoidal AC voltage having a predetermined cycle, which apparatus contains at least one inductive winding means of electrical insulated wire located on a core of magnetic material and circuit means operatively connecting said winding in circuit with said lamp for supplying AC operating voltage thereto; said lamp requiring a high starting voltage, higher than the voltage of said AC source, and at least ten times greater than its operating voltage; first capacitor means; first semiconductor controlled rectifier type electronic switching means, having alternate current conducting and nonconducting states and a gate input terminal, responsive to a predetermined voltage at said gate for switching into the conductive state; voltage breakdown switch device means connected in series with said gate input terminal, said breakdown device requiring a predetermined level of voltage thereacross to switch into an electrically conductive state to provide a predetermined voltage to said gate input; said first capacitor means and said first electronic switching means being coupled in circuit with at least a portion of said winding means to provide a discharge current path for any electrical charge in said first capacitor that extends through said winding portion responsive to said first electronic switching means being in the current conducting condition, whereby a high voltage pulse may be generated across said winding means through transformer action of a level exceeding the lamp starting voltage, and trigger circuit means for providing during a portion of an AC half cycle a voltage of a level sufficient to switch said voltage breakdown device at least once during each AC cycle only during the period when said AC voltage across said lamp is in excess of said lamp operating voltage; the improvement therein comprising in combination:

cut-out means for inhibiting said voltage breakdown device at a predetermined interval of time subsequent to the direct or indirect application of AC voltage from said source across said winding to prevent operation of said first electronic switching means, said last named means comprising:

AC to DC rectifier means for providing at an output a DC voltage responsive to the application of AC voltage to said winding means;

electronic switching device means having a first input, a second input, and an output;

means coupling the first input to said rectifier means output for supplying DC voltage to said first input;

said switching device means capable of providing a first or second output at the said output thereof, alternately, in the presence of DC voltage at said first input, responsive to a voltage at said second input being below or above, respectively, a predetermined voltage level;

timing network means having an input coupled to said rectifier means output and having an output coupled to said second input of said switching device means for providing at its output a voltage above said predetermined voltage level responsive to the continued presence of said DC voltage at said rectifier means output for at least a predetermined time interval, said time interval being greater than the normal starting time of a lamp, and further responsive to the absence of DC voltage at said rectifier means output for providing at its output a voltage of less than said predetermined voltage level;

means coupling said output of said switching device means in circuit with said voltage breakdown device means for inhibiting operation of said voltage breakdown device means responsive to said switching device means providing a second output.

2. The invention as defined in claim 1 wherein said electronic switching device means comprises: voltage comparator means containing means for comparing a voltage applied at a first input with another voltage applied at a second input.

3. The invention as defined in claim 1 wherein said timing means comprises a series circuit of a resistor and a capacitor; said second electronic switch means comprises a voltage comparator switch means having an input of a high resistance; said input being connected to the juncture of said resistor and capacitor; and wherein said rectifier means includes means for stabilizing the DC output voltage thereof for application across said series RC circuit and to said timing means.

4. The invention as defined in claim 2 wherein said voltage breakdown device comprises a Zener diode and a diac electrically connected in series and poled in the same direction; means connecting the circuit juncture of said diac and Zener diode in series with a rectifier diode to the output of said timing means to provide a shunt current path and prevent said Zener diode from conducting current subsequent to said timing means being in the second state.

5. The invention as defined in claim 3 further comprising a second winding on said magnetic core coupled to the input of said rectifier means for providing an AC voltage to said rectifier means concurrently with the appearance of an AC voltage across said first winding.

6. The invention as defined in claim 1 further comprising switch means for connecting or disconnecting alternately, AC voltages to said winding.

7. Means for starting and operating a gaseous discharge type lamp of the type requiring a high starting voltage and a substantially lower operating voltage, the ratio $V_{start}/V_{operate} > 10$, comprising in combination:

(a) ballast means, including at least a winding of electrically insulated wire located on a core of magnetic material, said winding containing first and second winding ends and a tap at some location between said ends;

(b) means for connecting said gaseous discharge type lamp in a series electrical circuit across said winding;

(c) means for connecting a source of cyclically varying AC voltage in circuit with said ballast means for supplying AC power thereto;

(d) said winding being adapted to supply AC voltage to said lamp, and said lamp, when in the operated condition, functioning to draw current through said winding;

(e) first thyristor means having a gate input;

(f) first capacitor means;

(g) first resistor means;

(h) means connecting said first capacitor means, resistor means, and thyristor means in series circuit across said lamp;

whereby the voltage across said series circuit is essentially the same as the voltage appearing across said lamp;

(i) second thyristor means; said second thyristor means having a gate input; p1 (j) means connecting said second thyristor means in series circuit between the juncture of said first resistor means and said first capacitor means and the said winding tap;

whereby said first capacitor means may be discharged through a portion of said winding when said second thyristor means switches into the current conducting condition to generate a high voltage pulse across said winding;

(k) second resistor means;

(l) second capacitor means;

(m) said second resistor and capacitor means being connected in series circuit across said second thyristor;

whereby said second capacitor means may electrically charge to at least a predetermined voltage level during each AC half cycle only when said lamp is in the noncurrent conducting condition and concurrently, said first thyristor means is in the current conducting condition;

(n) voltage breakdown device means connected in series circuit between a circuit juncture between said second resistor means and said second capacitor means and said gate input of said second thyristor means for conducting current when the voltage across said second capacitor means exceeds said predetermined voltage level and applying said current through the gate input of said second thyristor means to switch said thyristor means into the current conducting condition;

(o) AC to DC rectifier means for providing at an output a DC voltage responsive to the application of AC voltage from said AC source to said ballast means and for terminating said DC output responsive to the absence of AC voltage to said ballast means;

(p) electronic timing circuit means having an input coupled to said output of said rectifier circuit means and having an output connected to said gate of said second thyristor means; said timing circuit means including:

(1) an R-C timing network having a predetermined time constant substantially larger than the period of several AC cycles, including a resistor and a capacitor;

(p2) a timer electronic switch means having an input and an output; said capacitor being connected to the input of said timer switch means and adapted to charge electrically to a predetermined voltage level upon the lapse of a predetermined time interval during the presence of DC voltage at said input; said timer electronic switch means adapted to be placed in a first condition when the voltage on said timing network capacitor means is less than said predetermined level and to be placed in a second condition when said voltage on said timing network capacitor means exceeds said predetermined level; said timer means providing an output in the first condition of a level and polarity to normally place said first thyristor means in the current conducting condition and in the second condition for placing said thyristor means in the noncurrent-conducting condition; and (p3) bleeder resistance means for gradually discharging said capacitor means during the absence of said DC voltage at said input, whereby the voltage across said capacitor falls below said predetermined voltage level.

8. The invention as defined in claim 7 further comprising a fourth capacitor means connected in series circuit with said winding.

9. The invention as defined in claim 7 wherein said ballast means further comprises a second winding of electrically insulated wire located on said core of magnetic material in electromagnetic relationship with said winding, and means for connecting said source across said second winding.

10. The invention as defined in claim 9 further comprising tap means on said second winding at a position intermediate the ends thereof and wherein said AC to DC rectifier means contains an input connected between said tap and one end of said second winding.

11. The invention as defined in claim 8 wherein said ballast means further includes a second winding of electrically insulated wire located on said core of magnetic material in electromagnetic energy coupling relationship with said first winding, said second winding containing a tap intermediate the ends thereof; and wherein said fourth capacitor means is connected between one end of said first winding and said tap means and wherein said lamp is connected to one end of said second winding.

12. The invention as defined in claim 11 further comprising a third winding of electrically insulated wire wound over said second winding; means for connecting the input of said AC to DC rectifier means to said third winding.

13. Means for starting and operating a gaseous discharge type lamp of the type requiring a high starting voltage and a substantially lower operating voltage, the ratio $V_{start}/V_{operate} > 10$, comprising in combination:

(a) ballast means, including at least a first winding of a predetermined number of turns of electrically insulated wire located on a core of magnetic material, said winding containing first and second winding ends and an intermediate tap, said intermediate tap defining a winding portion of a predetermined number of turns between said tap and one of said winding ends, whereby the ratio between the turns remaining and said defined winding portion is substantially larger than one;

(b) means for connecting said gaseous discharge type lamp in a series electrical circuit across said winding;

(c) means for connecting a source of cyclically varying AC voltage in circuit with said ballast means for supplying AC power thereto;

(d) said winding being adapted to supply AC voltage to said lamp and said lamp, when in the operated condition, functioning to draw current through said winding;

(e) unidirectional current conducting semiconductor controlled rectifier means having a gate input;

(f) rectifier diode means connected in circuit across said semiconductor controlled rectifier means in reverse polarity relationship therewith;

(g) first capacitor means;

(h) means connecting said semiconductor controlled rectifier and said first capacitor means in series circuit between said tap and one terminal of said lamp, whereby said rectifier diode means may conduct current in one direction to charge said capacitor when said controlled rectifier means cannot, and whereby said controlled rectifier means conducts current on an opposite AC half cycle responsive to a predetermined input at said gate input terminal;

(i) second resistor means and second capacitor means connected in series circuit across said lamp for providing across said capacitor a time varying voltage corresponding to the time varying voltage applied across said lamp to permit said voltage to attain a predetermined voltage level during each AC half cycle in which said lamp is in a noncurrent conducting condition;

(j) Zener diode means and diac means, said Zener diode means and diac means connected in series circuit and poled in the same direction between said gate input terminal and a circuit juncture between said second resistor means and said second capacitor means, said series circuit normally being nonconductive when the voltage thereof is of a reverse polarity and operative to switch into a current conducting condition only when the reverse polarity voltage at said circuit juncture attains a predetermined voltage level;

(k) AC to DC rectifier means for providing at an output a DC voltage responsive to the application of AC voltage from said AC source to said ballast means and for terminating said DC output responsive to the absence of AC voltage to said ballast means;

(l) timing circuit means having an input coupled to the output of said AC to DC rectifier means and having an output, said timing circuit means including an R-C timing network having a predetermined time constant substantially larger than the duration of several AC cycles of said source means including a resistor and a capacitor;

(m) an electronic switch means having an input and an output, said input being connected to said timing circuit capacitor means; said timing circuit capacitor means adapted to charge to a predetermined voltage level upon the lapse of a predetermined time interval during the presence of DC voltage from said AC to DC rectifier means; said electronic switch means adapted to be placed in a first condition when the voltage on said timing network capacitor means is less than said predetermined level and to be placed in a second condition when said voltage on said timing network capacitor means exdeeds said predetermined level;

(n) means coupling the output of said electronic switch means to a circuit juncture intermediate said Zener diode means and said diac means for shunting any current through said diac means from said Zener diode means when said timer switch means is in the second output condition, whereby said thyristor means cannot be thereafter triggered; and (o) bleeder resistance means for gradually discharging said timing circuit capacitor means during the absence of DC voltage from said rectifier means, whereby the voltage across said capacitor means may decrease below said predetermined voltage level.

14. The invention as defined in claim 13 wherein said coupling means comprises rectifier diode means.

15. The invention as defined in claim 13 wherein said AC to DC rectifier comprises:

an inductor choke;

rectifier diode means and resistor means connected in series;

said inductor forming an input to said AC to DC rectifier means;

a circuit common;

capacitor means connected intermediate said inductor means and said diode and said circuit common;

filter capacitor means connected across said resistor means and said circuit common; and Zener diode means connected across said filter capacitor means.

16. The invention as defined in claim 13 wherein said ballast means comprises further:

a primary winding comprising a predetermined number of turns of electrically insulated wire located on said magnetic core and electromagnetically loosely coupled to said first winding;

tap means on said second winding;

means coupling the input of said AC to DC rectifier means in circuit between said tap means and one end of said second winding, and means for connecting said AC source means to said second winding.

17. The invention as defined in claim 16 further comprising capacitor means located across said second winding.

* * * * *